US011713912B2

(12) United States Patent
Yokodo et al.

(10) Patent No.: US 11,713,912 B2
(45) Date of Patent: Aug. 1, 2023

(54) CRYOCOOLER AND STARTING METHOD OF CRYOCOOLER

(71) Applicant: SUMITOMO HEAVY INDUSTRIES, LTD., Tokyo (JP)

(72) Inventors: Takayuki Yokodo, Nishitokyo (JP); Shuji Oyama, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 77 days.

(21) Appl. No.: 17/518,587

(22) Filed: Nov. 4, 2021

(65) Prior Publication Data

US 2022/0146166 A1 May 12, 2022

(30) Foreign Application Priority Data

Nov. 9, 2020 (JP) ..... 2020-186513

(51) Int. Cl.
*F25B 49/02* (2006.01)
*F25B 9/14* (2006.01)

(52) U.S. Cl.
CPC ..... *F25B 49/02* (2013.01); *F25B 9/145* (2013.01); *F25B 2309/1427* (2013.01); *F25B 2500/26* (2013.01)

(58) Field of Classification Search
None
See application file for complete search history.

(56) References Cited

U.S. PATENT DOCUMENTS

| | | | | |
|---|---|---|---|---|
| 5,471,841 | A | 12/1995 | Inaguchi | |
| 9,470,436 | B2 | 10/2016 | Takahashi et al. | |
| 9,480,934 | B2 | 11/2016 | Matsui | |
| 2020/0378653 | A1 * | 12/2020 | Oyama | F25B 9/002 |

FOREIGN PATENT DOCUMENTS

| | | | | |
|---|---|---|---|---|
| JP | 2824365 | B2 | 11/1998 | |
| JP | 2994862 | B2 | 12/1999 | |
| JP | 4445187 | B2 | 4/2010 | |
| JP | 5868224 | B2 | 2/2016 | |
| JP | 6067423 | B2 | 1/2017 | |
| JP | 6975066 | B2 * | 12/2021 | F25B 49/00 |

* cited by examiner

*Primary Examiner* — Nael N Babaa
(74) *Attorney, Agent, or Firm* — HEA Law PLLC

(57) ABSTRACT

A cryocooler includes an expander that includes a cooling stage, an exhaust temperature sensor that measures an exhaust temperature which is a temperature of a working gas exhausted from the expander and outputs an exhaust temperature signal indicating the measured exhaust temperature, and a controller that compares, during execution of initial cooling in which the cooling stage is cooled from an initial temperature to a cryogenic temperature, the measured exhaust temperature to a reference temperature based on the exhaust temperature signal and completes the initial cooling in a case where a temperature difference between the measured exhaust temperature and the reference temperature is within a reference range.

7 Claims, 6 Drawing Sheets

CRYOCOOLER AND STARTING METHOD OF CRYOCOOLER

RELATED APPLICATIONS

The content of Japanese Patent Application No. 2020-186513, on the basis of which priority benefits are claimed in an accompanying application data sheet, is in its entirety incorporated herein by reference.

BACKGROUND

Technical Field

Certain embodiments of the present invention relate to a cryocooler and a starting method of a cryocooler.

Description of Related Art

A cryocooler is used in order to cool various objects such as a superconducting device used in a cryogenic temperature environment, a measuring device, or a sample. To cool an object with the cryocooler, first, it is necessary to start the cryocooler and to cool the cryocooler from an initial temperature, such as the room temperature, to a target cryogenic temperature. Such initial cooling of the cryocooler is also called cooldown of the cryocooler.

SUMMARY

According to an embodiment of the present invention, there is provided a cryocooler including an expander that includes a cooling stage, an exhaust temperature sensor that measures an exhaust temperature which is a temperature of the working gas exhausted from the expander and outputs an exhaust temperature signal indicating the measured exhaust temperature, and a controller configured to compare, during execution of initial cooling in which the cooling stage is cooled from an initial temperature to a cryogenic temperature, the measured exhaust temperature to a reference temperature based on the exhaust temperature signal and to complete the initial cooling in a case where a temperature difference between the measured exhaust temperature and the reference temperature is within a reference range.

According to another embodiment of the present invention, there is provided a starting method of a cryocooler including executing initial cooling in which a cooling stage of an expander is cooled from an initial temperature to a cryogenic temperature, measuring an exhaust temperature which is a temperature of the working gas exhausted from the expander during execution of the initial cooling, and comparing, during the execution of the initial cooling, the measured exhaust temperature to a reference temperature and completing the initial cooling when a temperature difference between the measured exhaust temperature and the reference temperature is within a reference range.

According to still another embodiment of the present invention, there is provided a cryocooler including an expander that includes a cooling stage, a high pressure line that is connected to the expander and in which a working gas supplied to the expander flows, a low pressure line that is connected to the expander and in which the working gas exhausted from the expander flows, a pressure sensor that measures a pressure of the high pressure line or a pressure of the low pressure line, and a controller configured to determine whether or not initial cooling in which the cooling stage is cooled from an initial temperature to a cryogenic temperature is completed based on any one of the pressure of the high pressure line and the pressure of the low pressure line, which are measured by the pressure sensor, during execution of the initial cooling.

According to still another embodiment of the present invention, there is provided a starting method of a cryocooler including executing initial cooling in which a cooling stage of an expander is cooled from an initial temperature to a cryogenic temperature, measuring a pressure of a working gas supplied to the expander or a pressure of a working gas exhausted from the expander during execution of the initial cooling, and determining whether or not the initial cooling is completed based on any one of the measured pressure of the working gas supplied to the expander and the measured pressure of the working gas exhausted from the expander during the execution of the initial cooling.

Any combination of the components described above and a combination obtained by switching the components and expressions of the present invention between methods, devices, and systems are also effective as an embodiment of the present invention.

DETAILED DESCRIPTION

In a typical cryocooler, in order to know that initial cooling is completed, a temperature sensor is attached to a part to be cooled to a cryogenic temperature, and the measured temperature from the temperature sensor is monitored in some cases. However, the temperature sensor that can measure a cryogenic temperature is relatively expensive.

It is desirable to provide a cryocooler that detects the completion of the initial cooling at affordable prices.

Hereinafter, an embodiment for carrying out the present invention will be described in detail with reference to the drawings. In the description and drawings, the same or equivalent components, members, and processing will be assigned with the same reference symbols, and redundant description thereof will be omitted as appropriate. The scales and shapes of shown parts are set for convenience in order to make the description easy to understand, and are not to be understood as limiting unless stated otherwise. The embodiment is merely an example and does not limit the scope of the present invention. All characteristics and combinations to be described in the embodiment are not necessarily essential to the invention.

Figure 1:
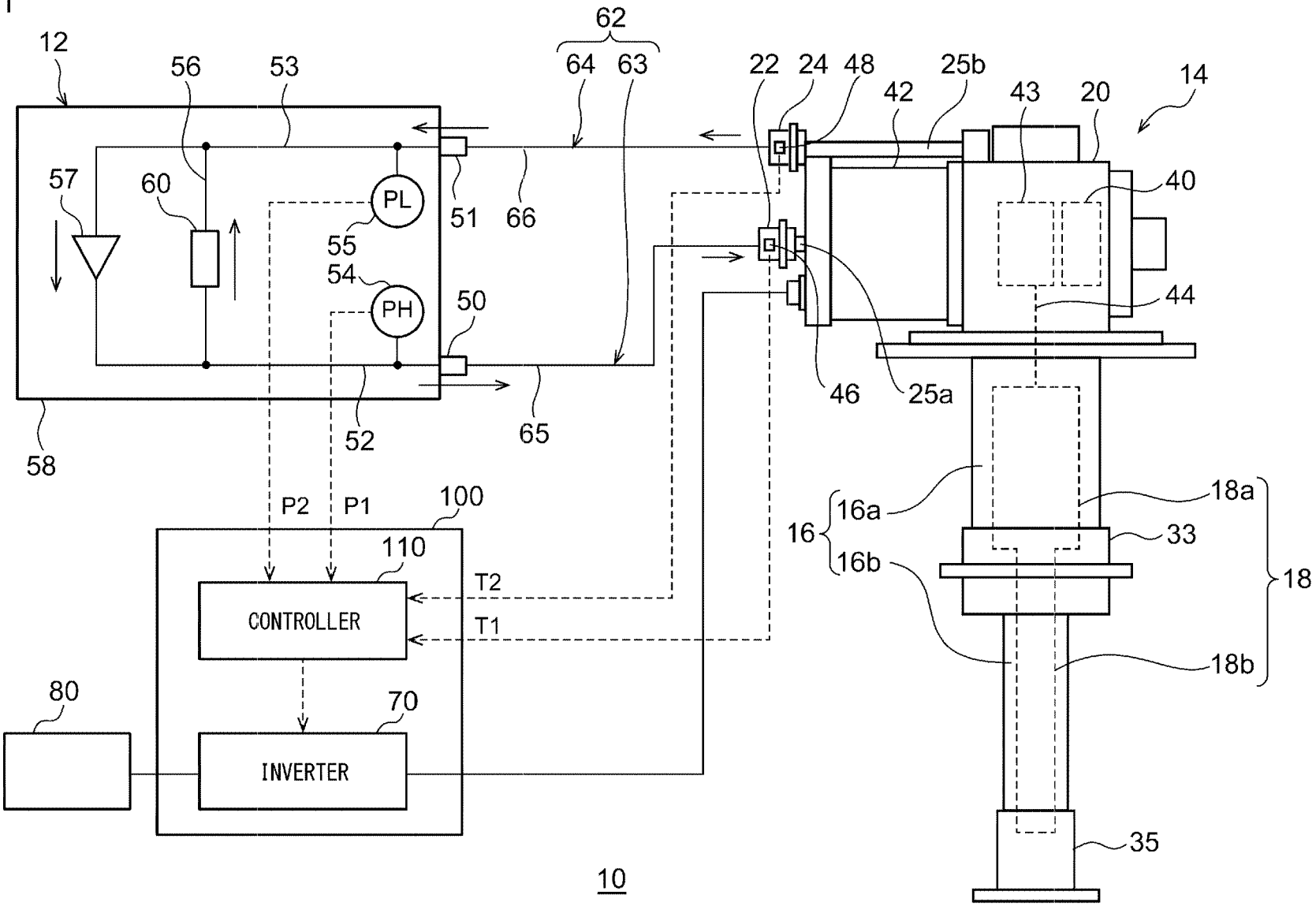
FIG. 1 is a view schematically showing a cryocooler according to an embodiment.
Figure 2:
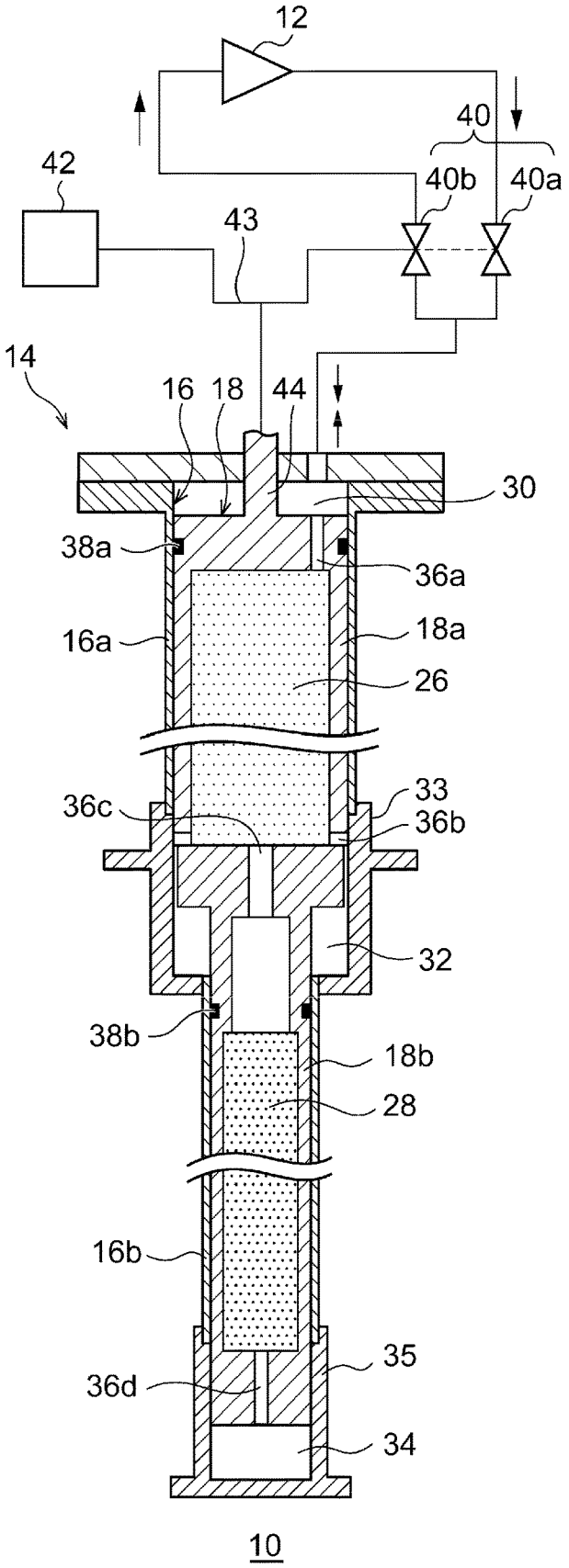
FIG. 2 is a view schematically showing the cryocooler according to the embodiment.

FIGS. 1 and 2 are views schematically showing a cryocooler 10 according to an embodiment. The cryocooler 10 is, for example, a two-stage type Gifford-McMahon (GM) cryocooler. FIG. 1 schematically shows a compressor 12 and an expander 14 that configure the cryocooler 10 together with a control device 100. FIG. 2 shows an internal structure of the expander 14 of the cryocooler 10.

The compressor 12 is configured to collect a working gas of the cryocooler 10 from the expander 14, to pressurize the collected working gas, and to supply the working gas to the expander 14 again. The compressor 12 and the expander 14 configure a refrigeration cycle of the cryocooler 10, and accordingly the cryocooler 10 can provide desired cryogenic temperature cooling. The expander 14 is also called a cold head. The working gas is also called a refrigerant gas, and other suitable gases may be used although a helium gas is typically used. To facilitate understanding, a direction in which the working gas flows is shown with arrows in FIG. 1.

In general, both of the pressure of a working gas to be supplied from the compressor 12 to the expander 14 and the pressure of a working gas to be collected from the expander 14 to the compressor 12 are considerably higher than the atmospheric pressure, and can be called a first high pressure and a second high pressure, respectively. For convenience of description, the first high pressure and the second high pressure are also simply called a high pressure and a low pressure, respectively. Typically, the high pressure is, for example, 2 to 3 MPa. The low pressure is, for example, 0.5 to 1.5 MPa, and is, for example, approximately 0.8 MPa. To facilitate understanding, a direction in which the working gas flows is shown with arrows.

The expander 14 includes a cryocooler cylinder 16 and a displacer assembly 18. The cryocooler cylinder 16 guides linear reciprocating motion of the displacer assembly 18 and forms expansion chambers (32 and 34) for the working gas with the displacer assembly 18. In addition, the expander 14 includes a pressure switching valve 40 that determines a timing when the working gas to the expansion chambers starts to be taken in and a timing when the working gas from the expansion chambers starts to be exhausted.

In the present specification, in order to describe a positional relationship between components of the cryocooler 10, for convenience of description, a side close to a top dead center of axial reciprocation of a displacer will be referred to as "up" and a side close to a bottom dead center will be referred to as "down". The top dead center is the position of the displacer at which the volume of an expansion space is maximum, and the bottom dead center is the position of the displacer at which the volume of the expansion space is minimum. Since a temperature gradient in which the temperature drops from an upper side to a lower side in an axial direction is generated during the operation of the cryocooler 10, the upper side can also be called a high temperature side and the lower side can also be called a low temperature side.

The cryocooler cylinder 16 includes a first cylinder 16*a* and a second cylinder 16*b*. The first cylinder 16*a* and the second cylinder 16*b* each are, for example, a member that has a cylindrical shape, and the second cylinder 16*b* has a diameter smaller than the first cylinder 16*a*. The first cylinder 16*a* and the second cylinder 16*b* are coaxially disposed, and a lower end of the first cylinder 16*a* is strongly connected to an upper end of the second cylinder 16*b*.

The displacer assembly 18 includes a first displacer 18*a* and a second displacer 18*b* that are connected to each other, and the displacers move integrally. The first displacer 18*a* and the second displacer 18*b* each are, for example, a member that has a cylindrical shape, and the second displacer 18*b* has a diameter smaller than the first displacer 18*a*. The first displacer 18*a* and the second displacer 18*b* are coaxially disposed.

The first displacer 18*a* is accommodated in the first cylinder 16*a*, and the second displacer 18*b* is accommodated in the second cylinder 16*b*. The first displacer 18*a* can reciprocate in the axial direction along the first cylinder 16*a*, and the second displacer 18*b* can reciprocate in the axial direction along the second cylinder 16*b*.

As shown in FIG. 2, the first displacer 18*a* accommodates a first regenerator 26. The first regenerator 26 is formed by filling a tubular main body portion of the first displacer 18*a* with, for example, a wire mesh made of, such as copper, or other appropriate first regenerator material. An upper lid portion and a lower lid portion of the first displacer 18*a* may be provided as members separate from the main body portion of the first displacer 18*a*, or the first regenerator material may be accommodated in the first displacer 18*a* by fixing the upper lid portion and the lower lid portion of the first displacer 18*a* to the main body through appropriate means such as fastening and welding.

Similarly, the second displacer 18*b* accommodates a second regenerator 28. The second regenerator 28 is formed by filling a tubular main body portion of the second displacer 18*b* with, for example, a non-magnetic regenerator material such as bismuth, a magnetic regenerator material such as $HoCu_2$, or other appropriate second regenerator material. The second regenerator material may be molded into a granular shape. An upper lid portion and a lower lid portion of the second displacer 18*b* may be provided as members separate from the main body portion of the second displacer 18*b*, or the second regenerator material may be accommodated in the second displacer 18*b* by fixing the upper lid portion and the lower lid portion of the second displacer 18*b* to the main body through appropriate means such as fastening and welding.

The displacer assembly 18 forms, inside the cryocooler cylinder 16, a room temperature chamber 30, a first expansion chamber 32, and a second expansion chamber 34. In order to exchange heat with a desired object or medium to be cooled by the cryocooler 10, the expander 14 includes a first cooling stage 33 and a second cooling stage 35. The room temperature chamber 30 is formed between the upper lid portion of the first displacer 18*a* and an upper portion of the first cylinder 16*a*. The first expansion chamber 32 is formed between the lower lid portion of the first displacer 18*a* and the first cooling stage 33. The second expansion chamber 34 is formed between the lower lid portion of the second displacer 18*b* and the second cooling stage 35. The first cooling stage 33 is fixed to a lower portion of the first cylinder 16*a* to surround the first expansion chamber 32, and the second cooling stage 35 is fixed to a lower portion of the second cylinder 16*b* to surround the second expansion chamber 34.

The first regenerator 26 is connected to the room temperature chamber 30 through a working gas flow path 36*a* formed in the upper lid portion of the first displacer 18*a*, and is connected to the first expansion chamber 32 through a working gas flow path 36*b* formed in the lower lid portion of the first displacer 18*a*. The second regenerator 28 is connected to the first regenerator 26 through a working gas flow path 36*c* formed from the lower lid portion of the first displacer 18*a* to the upper lid portion of the second displacer 18*b*. In addition, the second regenerator 28 is connected to the second expansion chamber 34 through a working gas flow path 36*d* formed in the lower lid portion of the second displacer 18*b*.

In order to introduce working gas flow between the first expansion chamber 32, the second expansion chamber 34, and the room temperature chamber 30 to the first regenerator 26 and the second regenerator 28 instead of a clearance between the cryocooler cylinder 16 and the displacer assembly 18, a first seal 38*a* and a second seal 38*b* may be provided. The first seal 38*a* may be mounted on the upper lid portion of the first displacer 18*a* to be disposed between the first displacer 18*a* and the first cylinder 16*a*. The second seal 38*b* may be mounted on the upper lid portion of the second displacer 18*b* to be disposed between the second displacer 18*b* and the second cylinder 16*b*.

As shown in FIG. 1, the expander 14 includes a cryocooler housing 20 that accommodates the pressure switching valve 40. The cryocooler housing 20 is coupled to the cryocooler cylinder 16, and accordingly a hermetic container that accommodates the pressure switching valve 40 and the displacer assembly 18 is configured.

As shown in FIG. 2, the pressure switching valve 40 is configured to include a high pressure valve 40*a* and a low pressure valve 40*b* and to generate periodic pressure fluctuations in the cryocooler cylinder 16. A working gas discharge port of the compressor 12 is connected to the room temperature chamber 30 via the high pressure valve 40*a*, and a working gas suction port of the compressor 12 is connected to the room temperature chamber 30 via the low pressure valve 40*b*. The high pressure valve 40*a* and the low pressure valve 40*b* are configured to open and close selectively and alternately (that is, such that when one is open, the other is closed).

The pressure switching valve 40 may take a form of a rotary valve. That is, the pressure switching valve 40 may be configured such that the high pressure valve 40*a* and the low pressure valve 40*b* are alternately opened and closed by rotational sliding of a valve disk with respect to a stationary valve main body. In this case, an expander motor 42 may be connected to the pressure switching valve 40 to rotate the valve disk of the pressure switching valve 40. For example, the pressure switching valve 40 is disposed such that a valve rotation axis is coaxial with a rotation axis of the expander motor 42.

Alternatively, the high pressure valve 40*a* and the low pressure valve 40*b* each may be a valve that can be individually controlled, and in this case, the pressure switching valve 40 may not be connected to the expander motor 42.

For example, the expander motor 42 is connected to a displacer drive shaft 44 via a motion conversion mechanism 43 such as a scotch yoke mechanism. The expander motor 42 is attached to the cryocooler housing 20. The motion conversion mechanism 43 is accommodated in the cryocooler housing 20 like the pressure switching valve 40. The motion conversion mechanism 43 converts rotating motion output by the expander motor 42 into linear reciprocating motion of the displacer drive shaft 44. The displacer drive shaft 44 extends from the motion conversion mechanism 43 into the room temperature chamber 30, and is fixed to the upper lid portion of the first displacer 18*a*. The rotation of the expander motor 42 is converted into the axial reciprocation of the displacer drive shaft 44 by the motion conversion mechanism 43, and the displacer assembly 18 linearly reciprocates in the axial direction in the cryocooler cylinder 16.

The expander motor 42 is, for example, a permanent magnet type motor driven by a three-phase alternating current. The operation frequency of the expander motor 42 is controlled by an inverter 70. The expander motor 42 can operate at a rotation speed according to the operation frequency of the expander motor 42. For example, the output frequency of the inverter 70 (that is, the operation frequency of the expander motor 42) can change within a range of 30 Hz to 100 Hz or a range of 40 Hz to 70 Hz.

The expander motor 42 and the inverter 70 are supplied with power from an external power source 80 such as a commercial power source (three-phase alternating current power source). The expander motor 42 and the inverter 70 may be, for example, supplied with power by being connected to the external power source 80 via the compressor 12, and in this case, the compressor 12 may be considered as a power source for the expander motor 42 and the inverter 70.

The compressor 12 includes a high pressure gas outlet 50, a low pressure gas inlet 51, a high pressure flow path 52, a low pressure flow path 53, a first pressure sensor 54, a second pressure sensor 55, a bypass line 56, a compressor main body 57, and a compressor casing 58. The high pressure gas outlet 50 is provided in the compressor casing 58 as a working gas discharge port of the compressor 12, and the low pressure gas inlet 51 is provided in the compressor casing 58 as a working gas suction port of the compressor 12. The high pressure flow path 52 connects a discharge port of the compressor main body 57 to the high pressure gas outlet 50, and the low pressure flow path 53 connects the low pressure gas inlet 51 to a suction port of the compressor main body 57. The compressor casing 58 accommodates the high pressure flow path 52, the low pressure flow path 53, the first pressure sensor 54, the second pressure sensor 55, the bypass line 56, and the compressor main body 57. The compressor 12 is also called a compressor unit.

The compressor main body 57 is configured to internally compress the working gas sucked from the suction port and to discharge the working gas from the discharge port. The compressor main body 57 may be, for example, a scroll type pump, a rotary type pump, or other pumps that pressurize the working gas. In the embodiment, the compressor main body 57 is configured to discharge the working gas at a fixed and constant flow rate. Alternatively, the compressor main body 57 may be configured to change the flow rate of the working gas to be discharged. The compressor main body 57 is called a compression capsule in some cases.

The first pressure sensor 54 is disposed in the high pressure flow path 52 to measure the pressure of the working gas flowing in the high pressure flow path 52. The first pressure sensor 54 is configured to output a first measured pressure signal P1 indicating the measured pressure. The second pressure sensor 55 is disposed in the low pressure flow path 53 to measure the pressure of the working gas flowing in the low pressure flow path 53. The second pressure sensor 55 is configured to output a second measured pressure signal P2 indicating the measured pressure. Accordingly, the first pressure sensor 54 and the second pressure sensor 55 can also be called a high pressure sensor and a low pressure sensor, respectively. In addition, in the present specification, any one of the first pressure sensor 54 and the second pressure sensor 55 or both of the first pressure sensor and the second pressure sensor will be collectively and simply referred to as a "pressure sensor" in some cases.

The bypass line 56 connects the high pressure flow path 52 to the low pressure flow path 53 such that the working gas bypasses the expander 14 and returns from the high pressure flow path 52 to the low pressure flow path 53. A relief valve 60 for opening and closing the bypass line 56 and controlling the flow rate of the working gas flowing in the bypass line 56 is provided in the bypass line 56. The relief valve 60 is configured to open when a differential pressure that is equal to or higher than a set pressure acts between an inlet and an outlet thereof. The relief valve 60 may be an on/off valve or a flow rate control valve, or may be, for example, a solenoid valve. It is possible to set the set pressure as appropriate based on empirical knowledge of a designer or experiments and simulations by the designer. Accordingly, a differential pressure between a high pressure line 63 and a low pressure line 64 can be prevented from exceeding the set pressure and becoming excessive. In addition, the pressure of the high pressure line 63 can be prevented from becoming excessive.

For example, the relief valve 60 may be opened and closed under the control of the control device 100. The control device 100 may compare a measured differential pressure between the high pressure line 63 and the low pressure line 64 to the set pressure, and control the relief valve 60 such that the relief valve 60 is opened in a case where the measured differential pressure is equal to or higher than the set pressure, and the relief valve 60 is closed in a case where the measured differential pressure is lower than the set pressure. The control device 100 may acquire the measured differential pressure between the high pressure line 63 and the low pressure line 64 based on the first measured pressure signal P1 from the first pressure sensor 54 and the second measured pressure signal P2 from the second pressure sensor 55. Alternatively, the control device 100 may compare the measured pressure of the high pressure line 63 to an upper limit pressure based on the first measured pressure signal P1, and control the relief valve 60 such that the relief valve 60 is opened in a case where the measured pressure is equal to or higher than the upper limit pressure, and the relief valve 60 is closed in a case where the measured pressure is lower than the upper limit pressure. As another example, the relief valve 60 may be configured to operate as a so-called safety valve, that is, may be mechanically opened when the differential pressure that is equal to or higher than the set pressure acts between the inlet and the outlet.

The compressor 12 can include other various components. For example, an oil separator or an adsorber may be provided in the high pressure flow path 52. A storage tank and other components may be provided in the low pressure flow path 53. In addition, an oil circulation system that cools the compressor main body 57 with an oil and a cooling system that cools the oil may be provided in the compressor 12.

In addition, the cryocooler 10 includes a gas line 62 that circulates the working gas between the compressor 12 and the expander 14. The gas line 62 includes the high pressure line 63 that connects the compressor 12 to the expander 14 such that the working gas is supplied from the compressor 12 to the expander 14 and the low pressure line 64 that connects the compressor 12 to the expander 14 such that the working gas is collected from the expander 14 to the compressor 12. Accordingly, the working gas taken into the expander 14 flows in the high pressure line 63, and the working gas exhausted from the expander 14 flows in the low pressure line 64.

A high pressure gas inlet 22 and a low pressure gas outlet 24 are provided in the cryocooler housing 20 of the expander 14. The high pressure gas inlet 22 is provided in the cryocooler housing 20 as a working gas intake port of the expander 14, and the low pressure gas outlet 24 is provided in the cryocooler housing 20 as a working gas exhaust port of the expander 14. As shown, a high pressure side connecting pipe 25*a* that includes the high pressure gas inlet 22 in a tip thereof and a low pressure side connecting pipe 25*b* that includes the low pressure gas outlet 24 in a tip thereof may extend from the cryocooler housing 20. The high pressure side connecting pipe 25*a* and the low pressure side connecting pipe 25*b* are, for example, rigid pipes, but may be flexible pipes.

The high pressure gas inlet 22 of the expander 14 is connected to the high pressure gas outlet 50 of the compressor 12 by a high-pressure pipe 65. The low pressure gas outlet 24 of the expander 14 is connected to the low pressure gas inlet 51 of the compressor 12 by a low-pressure pipe 66. The high pressure line 63 is formed by the high-pressure pipe 65 and the high pressure flow path 52, and the low pressure line 64 is formed by the low-pressure pipe 66 and the low pressure flow path 53. The high-pressure pipe 65 and the low-pressure pipe 66 are, for example, flexible pipes, but may be rigid pipes.

The bypass line 56 in the compressor 12 may be considered to be a part of the gas line 62. The bypass line 56 connects the high pressure line 63 to the low pressure line 64 such that the working gas bypasses the expander 14 and returns from the high pressure line 63 to the low pressure line 64.

Therefore, the working gas to be collected from the expander 14 to the compressor 12 enters the low pressure gas inlet 51 of the compressor 12 from the low pressure gas outlet 24 of the expander 14 through the low-pressure pipe 66, and further returns to the compressor main body 57 via the low pressure flow path 53 so as to be compressed and pressurized by the compressor main body 57. The working gas to be supplied from the compressor 12 to the expander 14 exits from the high pressure gas outlet 50 of the compressor 12 through the high pressure flow path 52 from the compressor main body 57, and is further supplied to the expander 14 via the high-pressure pipe 65 and the high pressure gas inlet 22 of the expander 14.

When the pressure of the high pressure line 63 exceeds the upper limit pressure, the relief valve 60 is opened, and some of the working gas flowing in the high pressure line 63 is diverted from the high pressure flow path 52 to the bypass line 56. Since the bypass line 56 joins the low pressure flow path 53, the working gas bypasses the expander 14 and returns to the compressor main body 57, and the pressure of the high pressure line 63 decreases. When the pressure of the high pressure line 63 falls below the upper limit pressure, the relief valve 60 is closed, and working gas flow from the high pressure line 63 to the low pressure line 64 through the bypass line 56 is blocked. Similarly, also a differential pressure between the high pressure line 63 and the low pressure line 64 can be adjusted so as not to exceed the set pressure through the relief valve 60.

In addition, an intake temperature sensor 46 and an exhaust temperature sensor 48 are provided at the expander 14. The intake temperature sensor 46 is configured to measure an intake temperature which is a temperature of the working gas supplied to the expander 14 and to output an intake temperature signal T1 indicating the measured intake temperature. The exhaust temperature sensor 48 is configured to measure an exhaust temperature which is a temperature of the working gas exhausted from the expander 14 and to output an exhaust temperature signal T2 indicating the measured exhaust temperature.

The intake temperature sensor 46 is provided, for example, in the high pressure gas inlet 22 of the expander 14, and the exhaust temperature sensor 48 is provided, for example, in the low pressure gas outlet 24 of the expander 14. However, the intake temperature sensor 46 can be provided at any place unless the temperature of the working gas taken into the expander 14 can be measured. For example, the intake temperature sensor 46 may be provided inside or on an outer surface of the high pressure side connecting pipe 25*a*, or may be provided between the high pressure gas inlet 22 and the high-pressure pipe 65 or inside or on an outer surface of the high-pressure pipe 65. Similarly, the exhaust temperature sensor 48 can be provided at any place unless the temperature of the working gas exhausted from the expander 14 can be measured. For example, the exhaust temperature sensor 48 may be provided inside or on an outer surface of the low pressure side connecting pipe 25*b*, or may be provided between the low pressure gas outlet 24 and the low-pressure pipe 66 or inside or on an outer surface of the low-pressure pipe 66.

In this manner, the intake temperature sensor 46 and the exhaust temperature sensor 48 are provided in the non-cooling portions of the cryocooler 10. The temperature sensors may be provided in the gas line 62 without being limited to the expander 14. However, in order to accurately measure the temperature of the working gas to be taken into and exhausted by the expander 14 by avoiding the effect of a temperature change (for example, cooling) caused by the ambient environment, it is preferable to provide the intake temperature sensor 46 and the exhaust temperature sensor 48 at the expander 14 or in the vicinity thereof instead of providing at the compressor 12.

As shown in FIG. 1, the control device 100 that controls the cryocooler 10 includes a controller 110 that controls the inverter 70. The controller 110 is electrically connected to the intake temperature sensor 46 and the exhaust temperature sensor 48 to acquire the intake temperature signal T1 and the exhaust temperature signal T2. In addition, the controller 110 is electrically connected to the first pressure sensor 54 and the second pressure sensor 55 to acquire the first measured pressure signal P1 and the second measured pressure signal P2.

Although the control device 100 is provided separately from the compressor 12 and the expander 14 and is connected thereto in the example shown, the invention is not limited thereto. The control device 100 may be mounted on the compressor 12. The control device 100 may be provided in the expander 14 such as being mounted on the expander motor 42. Alternatively, the controller 110 and the inverter 70 may be provided separately from each other such as the controller 110 is mounted on the compressor 12 and the inverter 70 is mounted on the expander 14.

The control device 100 is realized by an element or a circuit including a CPU and a memory of a computer as a hardware configuration and is realized by a computer program as a software configuration, but is shown in FIG. 1 as a functional block realized in cooperation therewith. It is clear for those skilled in the art that the functional blocks can be realized in various manners in combination with hardware and software.

When the compressor 12 and the expander motor 42 are operated, the cryocooler 10 causes periodic volume fluctuations in the first expansion chamber 32 and the second expansion chamber 34 and pressure fluctuations of the working gas in synchronization therewith. Typically, in an intake process, as the low pressure valve 40*b* is closed and the high pressure valve 40*a* is opened, a high pressure working gas flows from the compressor 12 into the room temperature chamber 30 through the high pressure valve 40*a*, is supplied to the first expansion chamber 32 through the first regenerator 26, and is supplied to the second expansion chamber 34 through the second regenerator 28. In this manner, the first expansion chamber 32 and the second expansion chamber 34 are pressurized from a low pressure to a high pressure. In this case, the displacer assembly 18 is moved upward from the bottom dead center to the top dead center, and the volumes of the first expansion chamber 32 and the second expansion chamber 34 are increased. When the high pressure valve 40*a* is closed, the intake process ends.

In an exhausting process, since the high pressure first expansion chamber 32 and the high pressure second expansion chamber 34 are opened to the low pressure working gas suction port of the compressor 12, as the high pressure valve 40*a* is closed and the low pressure valve 40*b* is opened, the working gas is expanded by the first expansion chamber 32 and the second expansion chamber 34, and the working gas which has a low pressure as a result is discharged from the first expansion chamber 32 and the second expansion chamber 34 to the room temperature chamber 30 through the first regenerator 26 and the second regenerator 28. In this case, the displacer assembly 18 is moved downward from the top dead center to the bottom dead center, and the volumes of the first expansion chamber 32 and the second expansion chamber 34 are decreased. The working gas is collected from the expander 14 to the compressor 12 through the low pressure valve 40*b*. When the low pressure valve 40*b* is closed, the exhausting process ends.

In this manner, for example, a refrigeration cycle such as a GM cycle is configured, and the first cooling stage 33 and the second cooling stage 35 are cooled to desired cryogenic temperatures. The first cooling stage 33 can be cooled to a first cooling temperature within a range of, for example, approximately 20 K to approximately 40 K. The second cooling stage 35 can be cooled to a second cooling temperature (for example, approximately 1 K to approximately 4 K) lower than the first cooling temperature.

The cryocooler 10 can perform steady operation and cooldown operation prior to the steady operation. The cooldown operation is an operation mode in which the cryocooler is rapidly cooled from an initial temperature to a cryogenic temperature when the cryocooler 10 is started. The steady operation is an operation mode of the cryocooler 10 in which a state where the cryocooler is cooled to the cryogenic temperature through the cooldown operation is maintained. The initial temperature may be an ambient temperature (for example, the room temperature). The cryocooler 10 is cooled to a standard cooling temperature through the cooldown operation, and is maintained within an allowable temperature range of a cryogenic temperature including the standard cooling temperature in the steady operation. The standard cooling temperature varies according to the application and setting of the cryocooler 10, but is typically, for example, approximately 4.2 K or lower in the cooling application of a superconductive device. In some other cooling applications, the standard cooling temperature may be, for example, approximately 10 K to 20 K, or may be 10 K or lower. Switching from the cooldown operation to the steady operation may be controlled by the control device 100. As described above, cooldown can also be called initial cooling.

Since the initial cooling is merely preparation for beginning the cooling of an object by the cryocooler, it is desirable that time taken for the cooldown is as short as possible. Thus, "accelerated cooling" is used in some cases. In the accelerated cooling, the inverter 70 controls the operation frequency of the expander motor 42 such that the operation frequency becomes, for example, a frequency higher than the power source frequency of the external power source 80. Since an increase in the operation frequency of the expander motor 42 precisely corresponds to an increase in the number of times of the refrigeration cycle of the cryocooler 10 per unit time, the cooling capacity of the cryocooler 10 can be increased. Therefore, the cooldown time of the cryocooler 10 can be shortened through the accelerated cooling.

At first glance, it seems that the cryocooler 10 can continue to exhibit a high cooling capacity insofar as the expander motor 42 is continuously driven at a high operation frequency not only during the initial cooling but also during the steady operation. However, this is not actually the case. When the expander motor 42 is continuously driven at a high operation frequency, the cooling capacity rather decreases and becomes insufficient in some cases.

Since the flow rate of the working gas necessary for the expander 14 in order for the cryocooler 10 to output at a predetermined cooling capacity is correlated with a change in the density of the working gas depending on a cooling temperature, the lower the flow rate of the working gas, the higher the temperature, which is preferable. For this reason, when the discharge flow rate of the compressor 12 is constant, the higher the cooling temperature, the higher the flow rate of the excess working gas, and a differential pressure between the high pressure line 63 and the low pressure line 64 tends to increase. As described above, the working gas can return through the bypass line 56 in order to avoid the generation of an excessive differential pressure. Accordingly, during the initial cooling in which the temperature is higher than the steady operation (in particular, at the beginning of the initial cooling), a large amount of excess gas returns through the bypass line 56 and can become wasted. The accelerated cooling is reducing the returning excess gas by increasing the flow rate of the working gas used at the expander 14, and effectively using the discharge flow rate of the compressor 12.

Therefore, it is considered to provide a temperature sensor at a cooling stage (for example, the second cooling stage 35) of the cryocooler 10 and to give the cryocooler an automatic control function of detecting the completion of the initial cooling by monitoring a measured temperature, ending the initial cooling (and the accelerated cooling), and proceeding to steady cooling.

However, a temperature sensor that can measure a cryogenic temperature is necessary in order to realize this, but such a temperature sensor is relatively expensive. In a case where a temperature sensor for a cryogenic temperature is not mounted on the cryocooler in order to avoid a cost increase, a user of the cryocooler determines the completion of the initial cooling and manually ends accelerated cooling, complicating the work. Alternatively, the accelerated cooling is not used, and the shortening of cooldown time is limited.

Thus, the present inventor has found another simple and affordable technique of detecting the completion of cooldown without using a temperature sensor provided in a cryogenic temperature section. In the embodiment, as will be described later, the controller 110 is configured to compare a measured exhaust temperature to a reference temperature based on the exhaust temperature signal T2 during the execution of the initial cooling in which the cooling stage is cooled from an initial temperature to a cryogenic temperature, and to complete the initial cooling in a case where a temperature difference between the measured exhaust temperature and the reference temperature is within a reference range. The controller 110 may be configured to use a measured intake temperature as a reference temperature based on the intake temperature signal T1. The controller 110 may be configured to control the inverter 70 such that the operation frequency of the expander motor 42 is decreased when the initial cooling is completed.

Figure 3:
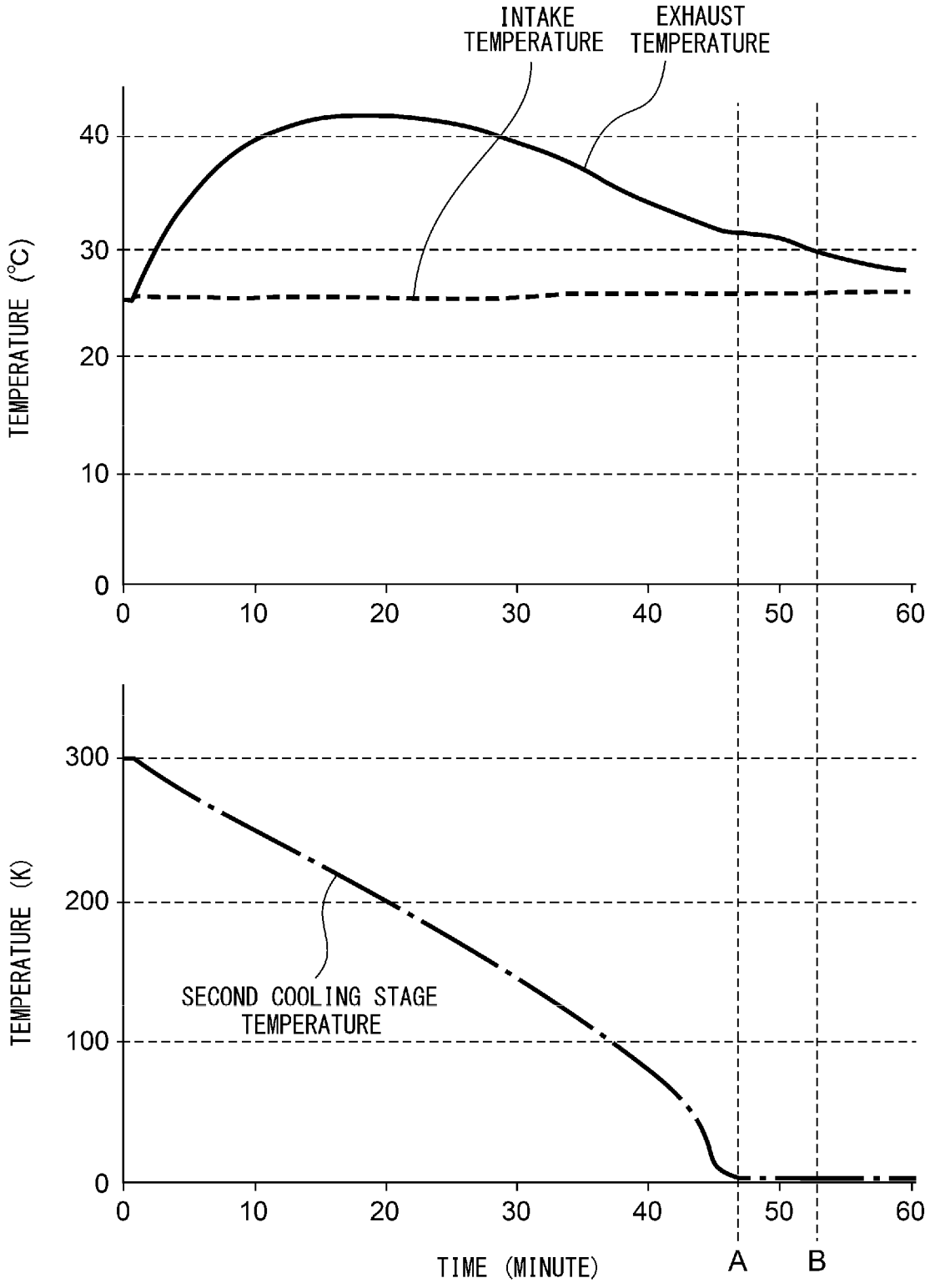
FIG. 3 is a graph showing an example of changes in an exhaust temperature and an intake temperature of an expander in initial cooling according to the embodiment.

FIG. 3 is a graph showing an example of changes in the exhaust temperature and the intake temperature of the expander 14 in the initial cooling according to the embodiment. The shown temperature changes are acquired through experiments, and the exhaust temperature and the intake temperature of the expander 14 measured by the exhaust temperature sensor 48 and the intake temperature sensor 46 are shown in an upper portion of FIG. 3. For examination, the cooling temperature of the second cooling stage 35 is also measured, and the cooling temperature is shown in a lower portion of FIG. 3. In this case, the bypass line 56 of the compressor 12 is controlled such that a differential pressure between the high pressure line 63 and the low pressure line 64 is constant.

As shown in FIG. 3, both of the exhaust temperature and the intake temperature are the ambient temperature (for example, approximately 25° C.) at a time point when the cryocooler 10 is started (time 0). The exhaust temperature increases to a certain maximum temperature (for example, approximately 42° C.) after the start of the initial cooling, and then gradually decreases toward the ambient temperature again. The intake temperature is approximately equal to the ambient temperature during the initial cooling. As described above, in a case where the ambient temperature does not fluctuate, the intake temperature is also constant according to the ambient temperature.

It can be seen from the graph that a temperature difference between the exhaust temperature and the intake temperature becomes wide immediately after the start of the initial cooling but the temperature difference reduces as the cooling of the second cooling stage 35 progresses. At a time point A (approximately 46 minutes in this example) when the second cooling stage 35 is cooled to the standard cooling temperature (for example, approximately 4 K) described above, the temperature difference between the exhaust temperature and the intake temperature is reduced to approximately 7° C. As time passes further, the temperature difference between the exhaust temperature and the intake temperature falls within several ° C. (for example, within 5° C. or within 3° C.) in the end. Therefore, at the time point A or a time point B when the temperature difference between the exhaust temperature and the intake temperature further decreases (at a time point when the temperature difference is within 5° C. in this example), it can be considered that the initial cooling is completed.

Figure 4:
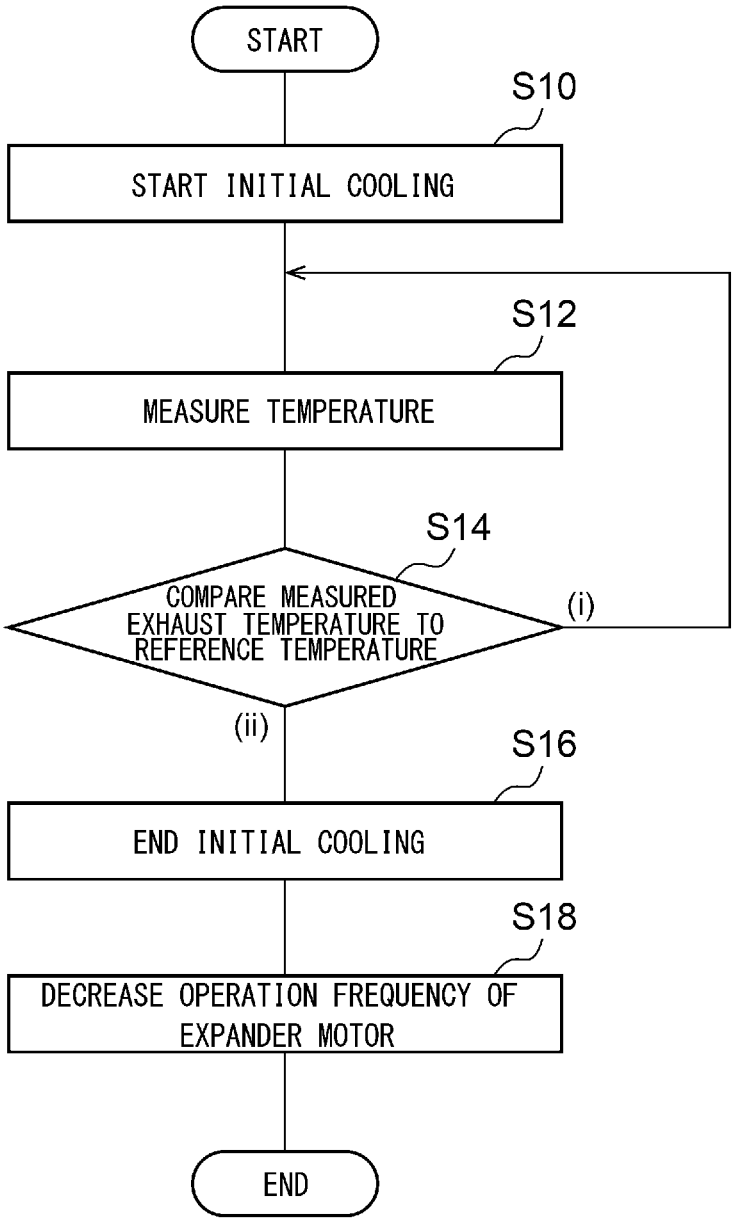
FIG. 4 is a flowchart showing a starting method of a cryocooler according to the embodiment.

FIG. 4 is a flowchart showing a starting method of the cryocooler 10 according to the embodiment. The present method is executed by the controller 110 when the cryocooler 10 is started. When the cryocooler 10 is started, the initial cooling is started (S10). In this case, the controller 110 may execute the accelerated cooling, or may control the inverter 70 such that the operation frequency of the expander motor 42 increases compared to a case of during the steady operation. The operation frequency of the expander motor 42 in the initial cooling may be higher than an input frequency (for example, 50 Hz or 60 Hz) from the external power source 80 to the inverter 70.

The exhaust temperature and the intake temperature of the expander 14 are measured (S12). These temperatures are measured using the intake temperature sensor 46 and the exhaust temperature sensor 48 as described above. The controller 110 acquires the measured intake temperature of the expander 14 from the intake temperature signal T1, and acquires the measured exhaust temperature of the expander 14 from the exhaust temperature signal T2.

The measured exhaust temperature is compared to the reference temperature (S14). In the embodiment, the measured intake temperature is used as the reference temperature. The controller 110 determines whether or not a temperature difference between the measured exhaust temperature and the reference temperature is within the reference range. In a case where the measured exhaust temperature is considerably higher than the reference temperature and the temperature difference between the measured exhaust temperature and the reference temperature is out of the reference range ((i) of S14), the initial cooling is continued, then the exhaust temperature and the intake temperature of the expander 14 are measured again (S12), and the measured exhaust temperature is compared to the reference temperature (S14).

Herein, the reference range may be, for example, within several ° C. (for example, within 5° C.). It is possible to set the reference range as appropriate based on empirical knowledge of the designer or experiments and simulations by the designer. The reference range is input to the controller 110 in advance by the user of the cryocooler 10, or is automatically set by the controller 110 and is stored in the controller 110.

In a case where the temperature difference between the measured exhaust temperature and the reference temperature is within the reference range ((ii) of S14), the controller 110 ends the initial cooling and proceeds to the steady operation of the cryocooler 10 (S16). In a case where the accelerated cooling is executed, the controller 110 controls the inverter 70 such that the operation frequency of the expander motor 42 is decreased (S18). That is, the controller 110 controls the inverter 70 such that the operation frequency of the expander motor 42 is changed from a first value for initial cooling to a second value for steady operation. A second operation frequency value for steady operation may be smaller than a first operation frequency value for initial cooling, and for example, may be equal to or lower than the input frequency (for example, 50 Hz or 60 Hz) from the external power source 80 to the inverter 70.

In this manner, the initial cooling of the cryocooler 10 is completed, and the steady operation is started. A cooling object thermally coupled to the second cooling stage 35 can be cooled to a target cryogenic temperature, and be used at the cryogenic temperature.

Therefore, in the cryocooler 10 according to the embodiment, the completion of the initial cooling can be detected from the measured exhaust temperature and the measured intake temperature of the expander 14 without measuring the temperature of a cryogenic cooling unit (for example, the second cooling stage 35) during the execution of the initial cooling. Since the intake temperature sensor 46 and the exhaust temperature sensor 48 are provided in the non-cooling portions of the cryocooler 10, a general-purpose temperature sensor that can measure approximately the room temperature can be used. A temperature sensor for cryogenic temperature measurement, which is more expensive than such a temperature sensor, is not required. Accordingly, the cryocooler that detects the completion of the initial cooling can be provided at affordable prices.

The measured intake temperature is used as the reference temperature to be compared to the measured exhaust temperature. In a case where the ambient temperature of the cryocooler 10 fluctuates, an effect thereof is considered to appear on both of the exhaust temperature and the intake temperature. Since a temperature difference between the measured exhaust temperature and the measured intake temperature is used in the embodiment, the effect of ambient temperature fluctuations can be offset.

It is not essential to use the measured intake temperature as the reference temperature. In a certain embodiment, the controller 110 may use the measured exhaust temperature when the initial cooling is started as the reference temperature. In this case, the cryocooler 10 may not include the intake temperature sensor 46, and only the exhaust temperature may be measured by the exhaust temperature sensor 48 in Step S12. In addition, in a case where the value of the ambient temperature is available, the controller 110 may use the ambient temperature value as the reference temperature. The controller 110 may use a temperature value (may be a fixed value) indicating the ambient temperature as the reference temperature.

In addition, in the embodiment, a decrease in the cooling capacity of the cryocooler 10 in the steady operation can be prevented by decreasing the operation frequency of the expander motor 42 when the initial cooling is completed.

In the embodiment described above, the accelerated cooling is performed during the initial cooling. However, the accelerated cooling is not essential. In a certain embodiment, during the initial cooling, the operation frequency of the expander motor 42 may be equal to the input frequency (for example, 50 Hz or 60 Hz) from the external power source 80 to the inverter 70, or the controller 110 may control the inverter 70 such that the operation frequency of the expander motor 42 is decreased when proceeding from the initial cooling to the steady operation.

The operation frequency of the expander motor 42 may be adjusted during the initial cooling or during the steady operation. For example, the controller 110 may perform control such that the operation frequency of the expander motor 42 is within the first range in the initial cooling, and perform control such that the operation frequency of the expander motor 42 is within the second range in the steady operation. The second range may be an operation frequency lower than the first range. The first range may be higher than the input frequency to the inverter 70, and the second range may be equal to or lower than the input frequency to the inverter 70.

It is also possible to detect the completion of the initial cooling from the pressure of the gas line 62, instead of the exhaust temperature of the expander 14. Such an embodiment will be described next.

Figure 5:
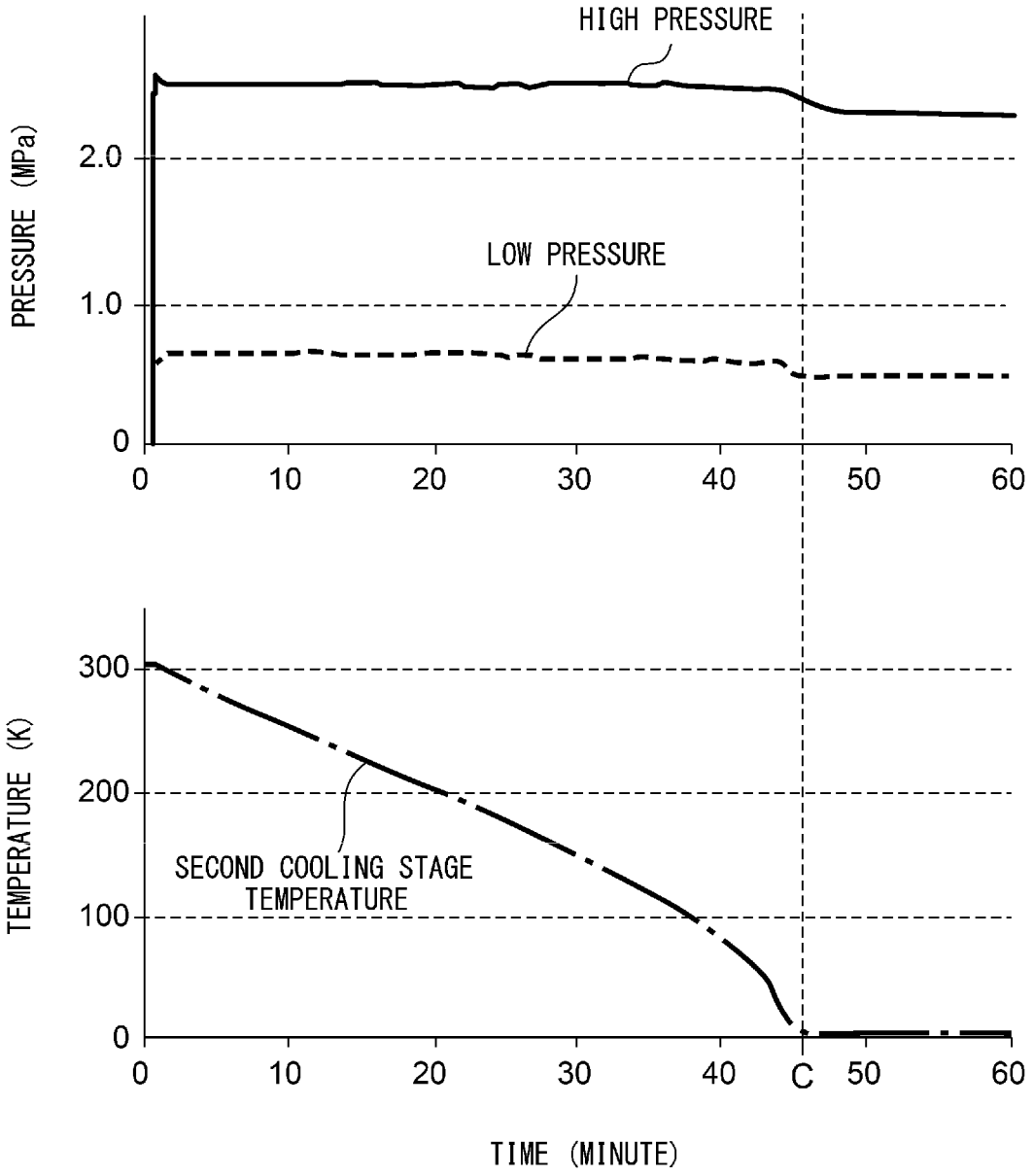
FIG. 5 is a graph showing an example of changes in pressures of a high pressure line and a low pressure line in the initial cooling according to the embodiment.

FIG. 5 is a graph showing an example of changes in the pressures of the high pressure line 63 and the low pressure line 64 in the initial cooling according to the embodiment. The shown pressure changes are acquired through experiments, and the pressures of the high pressure line 63 and the low pressure line 64, which are measured by the first pressure sensor 54 and the second pressure sensor 55, are shown in an upper portion of FIG. 4. For examination, the cooling temperature of the second cooling stage 35 is also measured, and the cooling temperature is shown in a lower portion of FIG. 4. In this case, the bypass line 56 of the compressor 12 is controlled such that a differential pressure between the high pressure line 63 and the low pressure line 64 is constant.

As shown in FIG. 5, the pressure of the high pressure line 63 is approximately 2.5 MPa, and the pressure of the low pressure line 64 is approximately 0.7 MPa at a time point when the cryocooler 10 is started (time 0). During the initial cooling, each of the pressures of the high pressure line 63 and the low pressure line 64 is kept substantially constant until the second cooling stage 35 is cooled to approximately 20 K. As cooling further progresses, substantially in synchronization with the cooling of the second cooling stage 35 from approximately 20 K to approximately 4 K, the pressure of the high pressure line 63 is decreased from approximately 2.5 MPa to approximately 2.3 MPa, and the pressure of the low pressure line 64 is decreased from approximately 0.7 MPa to approximately 0.5 MPa.

This pressure decreases are based on a relationship between the temperature and density of a helium gas used as the working gas. The density of the helium gas is significantly higher in a temperature range of approximately 20 to 30 K than in other temperature range. For this reason, the density of the helium gas is increased at the expansion chamber of the expander 14 when the second cooling stage 35 is cooled to approximately 20 to 30 K, and accordingly, the helium gas is absorbed from the gas line 62 to the expansion chamber. As a result, the pressure of the gas line 62 decreases as the second cooling stage is cooled from a temperature higher to lower than this temperature range.

Therefore, it can be considered that the initial cooling is completed at a time point C when the change amount of the measured pressure of the high pressure line 63 or the measured pressure of the low pressure line 64 increases beyond a threshold (at a time point when a pressure decrease amount exceeds, for example, 0.1 MPa in this example).

Figure 6:
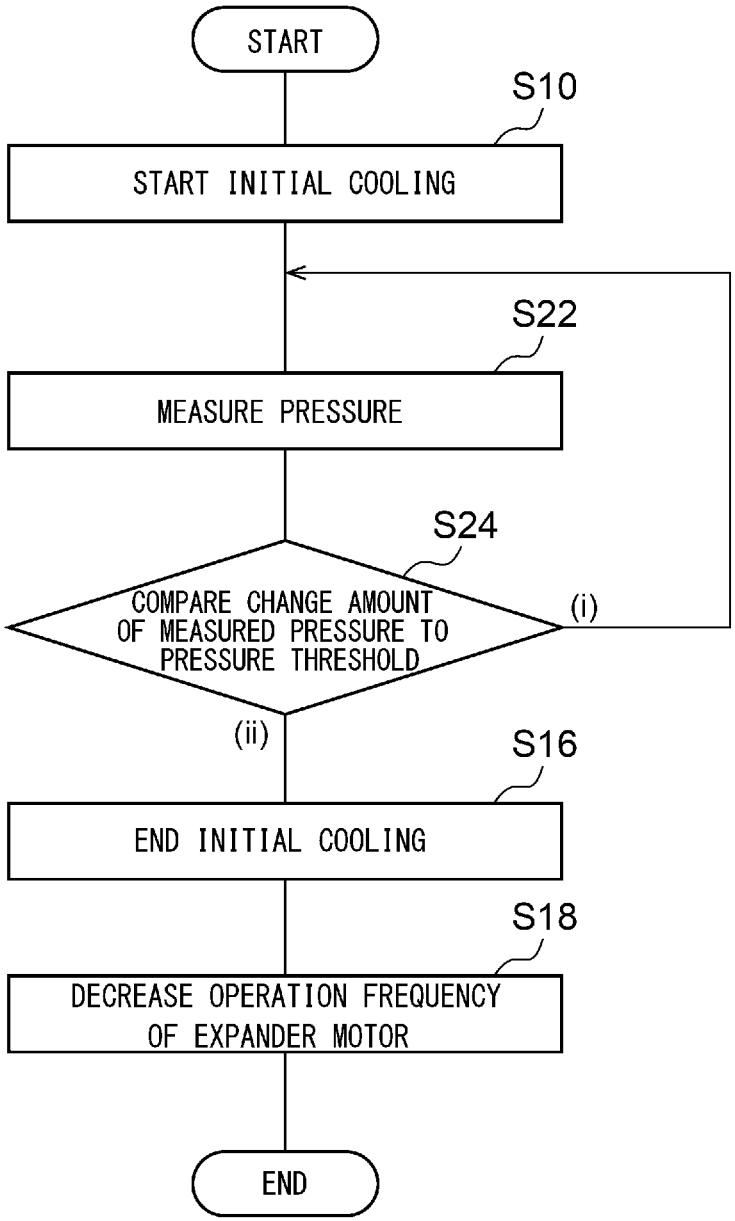
FIG. 6 is a flowchart showing the starting method of a cryocooler according to the embodiment.

FIG. 6 is a flowchart showing the starting method of the cryocooler 10 according to the embodiment. The present method is executed by the controller 110 when the cryocooler 10 is started. When the cryocooler 10 is started, the initial cooling is started (S10).

The pressure of the high pressure line 63 or the pressure of the low pressure line 64 is measured (S22). These pressures are measured using the first pressure sensor 54 or the second pressure sensor 55 as described above. The controller 110 can acquire the pressure of the high pressure line 63 from the first measured pressure signal P1 and acquire the pressure of the low pressure line 64 from the second measured pressure signal P2.

The change amount of the measured pressure is compared to a pressure threshold (S24). The controller 110 calculates the change amount of the measured pressure and compares the calculated change amount to the pressure threshold. The change amount of the measured pressure may be, for example, the change amount of the current measured pressure with respect to a measured pressure acquired at a time point when the initial cooling is started. In a case where the fluctuations of the measured pressure are small and the pressure change amount falls below the pressure threshold ((i) of S24), the initial cooling is continued and the pressure is measured again after then (S22). Thereafter, the change amount of the measured pressure is compared to the pressure threshold (S24).

Herein, the controller 110 may calculate the moving average of the measured pressure, calculate the change amount of the moving average, and compare the pressure change amount to the pressure threshold. The pressure threshold may be, for example, approximately 0.1 MPa. It is possible to set the pressure threshold as appropriate based on empirical knowledge of the designer or experiments and simulations by the designer.

In a case where the change amount of the measured pressure exceeds the pressure threshold ((ii) of S24), the controller 110 ends the initial cooling and proceeds to the steady operation of the cryocooler 10 (S16). In a case where the accelerated cooling is executed, the controller 110 controls the inverter 70 such that the operation frequency of the expander motor 42 is decreased (S18). In this manner, the initial cooling of the cryocooler 10 is completed, and the steady operation is started.

As described above, the controller 110 determines whether or not the initial cooling is completed based on any one of the pressure of the high pressure line 63 and the pressure of the low pressure line 64, which are measured by the pressure sensor, during the execution of the initial cooling. Therefore, in the cryocooler 10 according to the embodiment, the completion of the initial cooling can be detected from the pressure of the high pressure line 63 or the pressure of the low pressure line 64 without measuring the temperature of the cryogenic cooling unit (for example, the second cooling stage 35) during the execution of the initial cooling.

The controller 110 may determine whether or not the initial cooling is completed based on the pressure of the high pressure line 63 and determine whether or not the initial cooling is completed based on the pressure of the low pressure line 64. In a case where at least one (preferably both) of the determination based on the pressure of the high pressure line 63 and the determination based on the pressure of the low pressure line 64 indicates the completion of the initial cooling, the controller 110 may end the initial cooling and proceed to the steady operation.

The controller 110 may determine whether or not the initial cooling is completed based on a temperature and determine whether or not the initial cooling is completed based on a pressure. Determination based on a temperature may be, for example, determination based on comparison between the measured exhaust temperature and the reference temperature, which is described with reference to FIGS. 3 and 4. Determination based on a pressure may be, for example, determination based on comparison between the change amount of the measured pressure and the pressure threshold, which is described with reference to FIGS. 5 and 6. In a case where at least one (preferably both) of the determination based on a temperature and the determination based on a pressure indicates the completion of the initial cooling, the controller 110 may end the initial cooling and proceed to the steady operation.

As described above, in a case where the relief valve 60 is opened and closed under the control of the control device 100, different set pressures may be used for the initial cooling and the steady operation. During the initial cooling, the control device 100 may compare a measured differential pressure between the high pressure line 63 and the low pressure line 64 to a set pressure for initial cooling, and control the relief valve 60 such that the relief valve 60 is opened in a case where the measured differential pressure is equal to or higher than the set pressure, and the relief valve 60 is closed in a case where the measured differential pressure is lower than the set pressure. In addition, during the steady operation, the control device 100 may compare a measured differential pressure between the high pressure line 63 and the low pressure line 64 to a set pressure for steady operation, and control the relief valve 60 such that the relief valve 60 is opened in a case where the measured differential pressure is equal to or higher than the set pressure, and the relief valve 60 is closed in a case where the measured differential pressure is lower than the set pressure. Similarly, as the upper limit pressure determined for the high pressure line 63, different upper limit pressures may be used for the initial cooling and the steady operation.

The pressure sensors such as the first pressure sensor 54 and the second pressure sensor 55 are not necessarily provided in the compressor 12, and may be provided at any place where the pressure can be measured, such as the gas line 62 and the expander 14. For example, the first pressure sensor 54 may be provided at any place in the high pressure line 63, and the second pressure sensor 55 may be provided at any place in the low pressure line 64. In addition, similarly, the bypass line 56 and the relief valve 60 are not necessarily provided in the compressor 12 as well, and may be disposed outside the compressor 12 and connect the high pressure line 63 to the low pressure line 64.

Although a case where the cryocooler 10 is a two-stage type GM cryocooler has been described as an example in the embodiment described above, the invention is not limited thereto. The cryocooler 10 may be a single-stage type or a multi-stage type GM cryocooler, and may be other type of cryocooler including an expander motor that drives an expander, for example, a GM type pulse tube cryocooler.

The present invention has been described hereinbefore based on the examples. It is clear for those skilled in the art that the present invention is not limited to the embodiment, various design changes are possible, various modification examples are possible, and such modification examples are also within the scope of the present invention.

It should be understood that the invention is not limited to the above-described embodiment, but may be modified into various forms on the basis of the spirit of the invention. Additionally, the modifications are included in the scope of the invention.

What is claimed is:

1. A cryocooler comprising:

an expander including a cooling stage;

an exhaust temperature sensor that measures an exhaust temperature which is a temperature of a working gas exhausted from the expander and outputs an exhaust temperature signal indicating the measured exhaust temperature; and a controller configured to:

compare, during execution of initial cooling in which the cooling stage is cooled from an initial temperature to a cryogenic temperature, the measured exhaust temperature to a reference temperature based on the exhaust temperature signal and complete the initial cooling when a temperature difference between the measured exhaust temperature and the reference temperature is within a reference range.

2. The cryocooler according to claim 1, further comprising:

an intake temperature sensor that measures an intake temperature which is a temperature of the working gas supplied to the expander and outputs an intake temperature signal indicating the measured intake temperature, wherein the controller is configured to use the measured intake temperature as the reference temperature based on the intake temperature signal.

3. The cryocooler according to claim 1, further comprising:

a high pressure line that is connected to the expander and in which the working gas supplied to the expander flows;

a low pressure line that is connected to the expander and in which the working gas exhausted from the expander flows; and a pressure sensor that measures a pressure of the high pressure line or a pressure of the low pressure line, wherein the controller is configured to determine whether or not the initial cooling is completed based on any one of the pressure of the high pressure line and the pressure of the low pressure line, which are measured by the pressure sensor, during the execution of the initial cooling.

4. The cryocooler according to claim 1, further comprising:

an inverter that controls an operation frequency of a motor which drives the expander, wherein the controller is configured to control the inverter such that the operation frequency of the motor is decreased when the initial cooling is completed.

5. A starting method of a cryocooler comprising:

executing initial cooling in which a cooling stage of an expander is cooled from an initial temperature to a cryogenic temperature;

measuring an exhaust temperature which is a temperature of a working gas exhausted from the expander during execution of the initial cooling;

comparing, during the execution of the initial cooling, the measured exhaust temperature to a reference temperature; and completing the initial cooling when a temperature difference between the measured exhaust temperature and the reference temperature is within a reference range.

6. A cryocooler comprising:

an expander including a cooling stage;

a high pressure line that is connected to the expander and in which a working gas supplied to the expander flows;

a low pressure line that is connected to the expander and in which the working gas exhausted from the expander flows;

a pressure sensor that measures a pressure of the high pressure line or a pressure of the low pressure line; and a controller configured to determine whether or not initial cooling in which the cooling stage is cooled from an initial temperature to a cryogenic temperature is completed based on any one of the pressure of the high pressure line and the pressure of the low pressure line, which are measured by the pressure sensor, during execution of the initial cooling.

7. A starting method of a cryocooler comprising:

executing initial cooling in which a cooling stage of an expander is cooled from an initial temperature to a cryogenic temperature;

measuring a pressure of a working gas supplied to the expander or a pressure of the working gas exhausted from the expander during execution of the initial cooling; and determining whether or not the initial cooling is completed based on any one of the measured pressure of the working gas supplied to the expander and the measured pressure of the working gas exhausted from the expander during the execution of the initial cooling.

* * * * *